US006368423B1

(12) United States Patent
Otsuka et al.

(10) Patent No.: US 6,368,423 B1
(45) Date of Patent: Apr. 9, 2002

(54) PROCESS FOR PRODUCING AMORPHOUS MAGNETICALLY SOFT BODY

(75) Inventors: Isamu Otsuka, Sakai; Toru Kawai, Toyonaka; Atsunobu Shintani, Hirakata; Hiroshi Yamamoto, Higashiosaka; Isao Endo, Ikoma, all of (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 09/657,064

(22) Filed: Sep. 7, 2000

(30) Foreign Application Priority Data

Sep. 9, 1999 (JP) ..... 11-255271

(51) Int. Cl.[7] ..... H01F 1/24; H01F 1/22

(52) U.S. Cl. ..... 148/104; 419/10; 419/19; 419/35; 419/36

(58) Field of Search ..... 148/104; 419/10, 419/19, 35, 36

(56) References Cited

U.S. PATENT DOCUMENTS 4,923,533 A * 5/1990 Shigeta et al. ..... 148/304
5,178,689 A * 1/1993 Okamura et al. ..... 148/306
5,193,375 A * 3/1993 Sawa et al. ..... 148/306

FOREIGN PATENT DOCUMENTS

EP 0-936-638 A 8/1999

OTHER PUBLICATIONS

Database WPI; Section Ch, Week 198824, Derwent Publications Ltd., London, GB; AN 1988–165373 & JP 63–104408A (Nippon Kinzoku Co. Ltd.) May 9, 1988.

Patent Abstracts of Japan, vol. 012, No. 293; Aug. 10, 1988, & JP 63–070504 A; Mar. 30, 1988.

Patent Abstracts of Japan, vol. 1999, No. 14; Dec. 22, 1999; & JP 11–256202 A; Sep. 21, 1999.

* cited by examiner

*Primary Examiner*—John Sheehan
(74) *Attorney, Agent, or Firm*—Armstrong, Westerman & Hattori, LLP

(57) ABSTRACT

The invention improves the thermal conductivity of the material powder to be fired and also makes it possible to produce an amorphous magnetically soft body within a shortened period of time. The amorphous magnetically soft body is produced by preforming the material powder into a body first, and heating the preformed body without pressing. Stated more specifically, an amorphous magnetically soft body is produced from a material powder comprising a powder of an amorphous magnetically soft alloy, a glass having a softening point lower than the crystallization starting temperature of the alloy and a binding resin, by pressing the material powder in a preforming die to prepare a preformed body by the binding property of the resin, and firing the preformed body without pressing at a temperature higher than the softening point of the glass and lower than the crystallization starting temperature of the alloy to join the particles of the alloy with the glass.

5 Claims, 5 Drawing Sheets

PROCESS FOR PRODUCING AMORPHOUS MAGNETICALLY SOFT BODY

FIELD OF THE INVENTION

The present invention relates to a process for producing amorphous magnetically soft bodies with use of a glass of low softening point as a binder and also as an insulator.

BACKGROUND OF THE INVENTION

It is known that amorphous magnetically soft alloys exhibit more excellent characteristics than crystal materials in respect of corrosion resistance, wear resistance, strength, magnetic permeability, etc. These alloys are used as magnetic materials, for example, for magnetic cores of various devices for use in electric or electronic appliances.

The amorphous magnetically soft alloy is generally in the form of a thin strip, thin wire or powder because of the reasons involved in the quenching process for assuring the amorphous state. Accordingly, when members of specified shape are to be obtained with use of such an alloy in the form of a thin strip or wire, the alloy needs to be pulverized into a powder first and then pressed as heated at a predetermined temperature into bodies.

The powder of amorphous magnetically soft alloy needs to be formed into a body at a temperature lower than the crystallization starting temperature of the alloy so as to retain the amorphous state. However, the alloy powder can not be bulked at this temperature. Amorphous magnetically soft bodies are therefore produced by mixing a glass powder of low softening point with the alloy powder to obtain a material powder, filling the material powder into a hot-forming die, forming the material powder hot at a temperature higher than the softening point of the glass but lower than the crystallization starting temperature of the alloy powder to join the alloy particles to one another with the glass as softened and serving as a binder.

When the material powder as filled in the die is heated to the predetermined forming temperature, the material in the form of a powder has many voids between the particles, and is therefore small in overall thermal conductivity and liable to have a great temperature difference between the material portion adjacent to the wall of the die and the material portion in the center thereof. To heat the material powder uniformly for forming, the powder must be heated for about 20 to about 40 minutes, hence lower productivity.

Further when to be made into an amorphous magnetically soft body having varying wall thicknesses, the powder becomes uneven in temperature owing to the differences in wall thickness, failing to afford a body of uniform characteristics.

On the other hand, an attempt to heat the die to a higher temperature in order to give the powder an increased quantity of heat, shorten the heating time and achieve improved productivity, a still greater temperature difference occurs between the material portion close to the die wall and the material portion in the center, consequently entailing the problem that the temperature of the former portion exceeds the crystallization starting temperature of the alloy when the latter portion reaches the forming temperature to impair the amorphous property.

An object of the present invention is to make it possible to produce an amorphous magnetically soft body merely by heating a body which is formed by cold pressing.

SUMMARY OF THE INVENTION

To fulfill the above object, the present invention produces an amorphous magnetically soft body by preforming a material powder into a body first, and heating the preformed body without pressing.

Stated more specifically, an amorphous magnetically soft body is produced from a material powder comprising a powder of an amorphous magnetically soft alloy, a glass having a softening point lower than the crystallization starting temperature of the alloy and a binding resin, by pressing the material powder in a preforming die to prepare a preformed body by the binding property of the resin, and firing the preformed body without pressing at a temperature higher than the softening point of the glass and lower than the crystallization starting temperature of the alloy to join the particles of the alloy with the glass.

The material powder is pressed as placed in the preforming die and thereby consolidated with the binding resin into a preformed body.

The preformed body obtained is heated without pressing, whereby the binding resin is evaporated off, and the glass is softened to join the particles of the amorphous magnetically soft alloy with the glass. According to the present invention, the preformed body is prepared first which is more compact than powders and therefore has a higher thermal conductivity. Consequently, even if heated at an increased rate of rise of temperature, the preformed body can be maintained at a uniform temperature in its entirety without becoming overheated locally.

The preformed body need not be pressed during heating, and therefore need not be placed into a die but can be heated directly in a furnace. Thus, the production process of the invention achieves improved productivity and assures mass production. Furthermore, the binding resin can be evaporated off more effectively to remain in the body in a smaller amount than when the preheated body is heated as placed in a die.

DESCRIPTION OF THE PREFERRED EMBODIMENT

Figure 1:
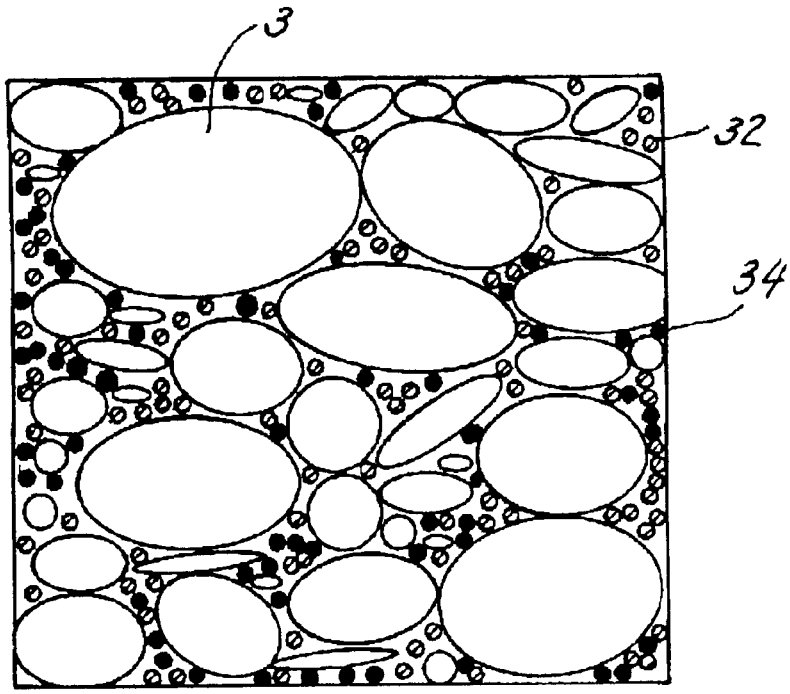
FIG. 1 is a diagram schematically showing a material powder I.

A description will be given of amorphous magnetically soft alloys, glasses and binding resins for use in the present invention.

Amorphous Magnetically Soft Alloys

Examples of amorphous magnetically soft alloys usable are Fe alloys (such as Fe-Si-B), Co alloys (such as Co-Fe-Si-B) and the like. These alloys have a crystallization starting temperature usually of about 500° C.

Powders of amorphous magnetically soft alloys can be prepared by various known processes such as the high-speed rotating water stream atomization process and rotating liquid atomization process.

It is desired that the amorphous magnetically soft alloy powder be up to about 250 μm in particle size. The mean particle size is about 30 to about 100 μm to be suitable.

Glasses

The glass to be used one having a softening point which is about 80 to about 400° C. lower than the crystallization starting temperature of the amorphous magnetically soft alloy. Preferably, the softening point is about 100 to about 400° C. so as to permit heat treatment over a range of temperatures. Examples of glass materials of this type are glasses of low softening point, such as lead oxide-containing borate glass ($PbO \cdot B_2O_3$) and three-component glasses comprising the borate glass, and ZnO or $SiO_2$ admixed therewith.

The glass is used preferably in an amount of 1 to 20 vol. % based on the material powder. An amount in this range is determined in accordance with the desired magnetic permeability. If used in a lesser amount, the glass fails to fully serve as a binder, presenting difficulty in bulking the amorphous magnetically soft alloy powder and entailing the likelihood the alloy particles will not be effectively insulated from one another. When the glass is used in an excessive amount, on the other hand, an increased mechanical strength will result, whereas the proportion of the amorphous magnetically soft alloy in the resulting body diminishes, entailing the likelihood that the body will not exhibit satisfactory magnetic characteristics.

Binding Resins

The binding resin to be used is a resin material having such binding properties as to consolidate the particles of the material powder into a mass which is compacted to some extent during preforming, enabling the preformed body to retain the specified shape after it is taken out of the preforming die, unless the body is subjected to an excessive force. Examples of such binding resin materials are epoxy resin, PVA, waxes and organic binders including soft phenolic resin and acrylic resin.

The material powder is prepared from the magnetically soft amorphous alloy, glass and binding resin described above.

Material Powders

The material powders usable include the following three examples.

Powder I; A powder comprising an amorphous magnetically soft alloy powder, glass powder and binding resin which are mixed together.

Powder II; A powder comprising composite particles obtained by coating an amorphous magnetically soft alloy powder with a glass over the surface, and a binding resin mixed with the particles.

Powder III; A powder comprising an amorphous magnetically soft alloy powder coated with both glass and binding resin over the surface.

The material powders I to III are prepared by the methods to be described below successively.

Material Powder I

The material powder I comprises an amorphous magnetically soft alloy powder, glass powder and binding resin. The binding resin to be used is in the form of a powder, liquid or gel. FIG. 1 is a diagram schematically showing the material powder comprising an amorphous magnetically soft alloy powder 3, glass powder 32 and powdery binding resin 34.

In the case where the powdery binding resin is used, the material powder is obtained by preparing the amorphous magnetically soft alloy powder, glass powder and binding resin powder and mixing these powders together. When the alloy powder is about 100 to about 150 μm in particle size, it is desirable that the glass powder be about 3 to about 7 μm in particle size and that the binding resin powder be about 0.1 to about 10 μm in particle size. Alternatively when the alloy powder is about 30 to about 100 μm in particle size, it is desirable that the glass powder be about 1 to about 5 μm in particle size and that the binding resin powder be about 0.1 to about 5 μm in particle size.

In the case where the binding resin to be used is in the form of a liquid or gel, a pasty material powder is prepared by mixing the alloy powder and the glass powder together, and adding the liquid or gel of binding resin to the mixture or to the alloy and glass powders being mixed together.

Preferably, the powders are mixed together or the binding resin is mixed with the powders in an inert gas atmosphere or in a vacuum.

Material Powder II

Figure 2:
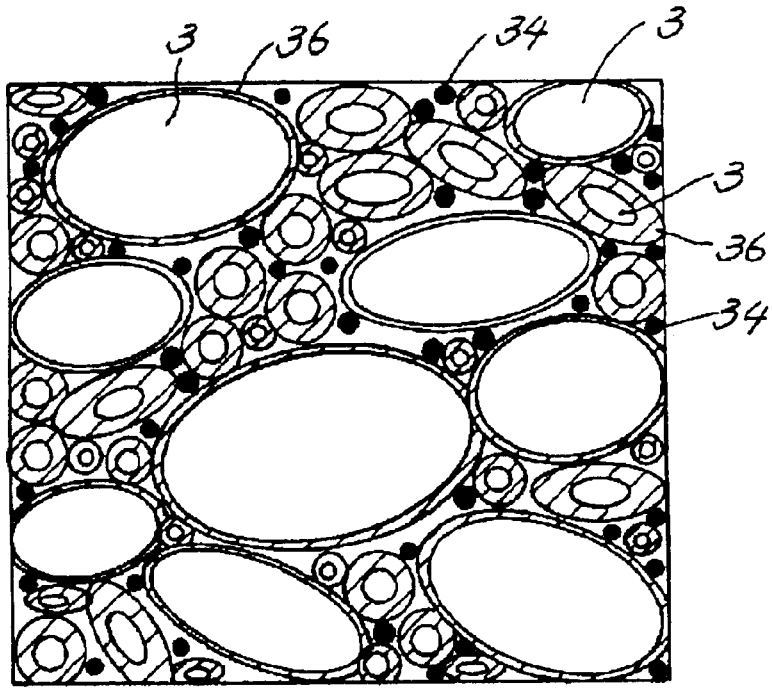
FIG. 2 is a diagram schematically showing a material powder II.

The material powder II is prepared by mixing a binding resin 34 with a powder of composite particles obtained by coating the surface of an amorphous magnetically soft powder 3 with a glass 36. FIG. 2 is diagram schematically showing this material powder.

Figure 5:
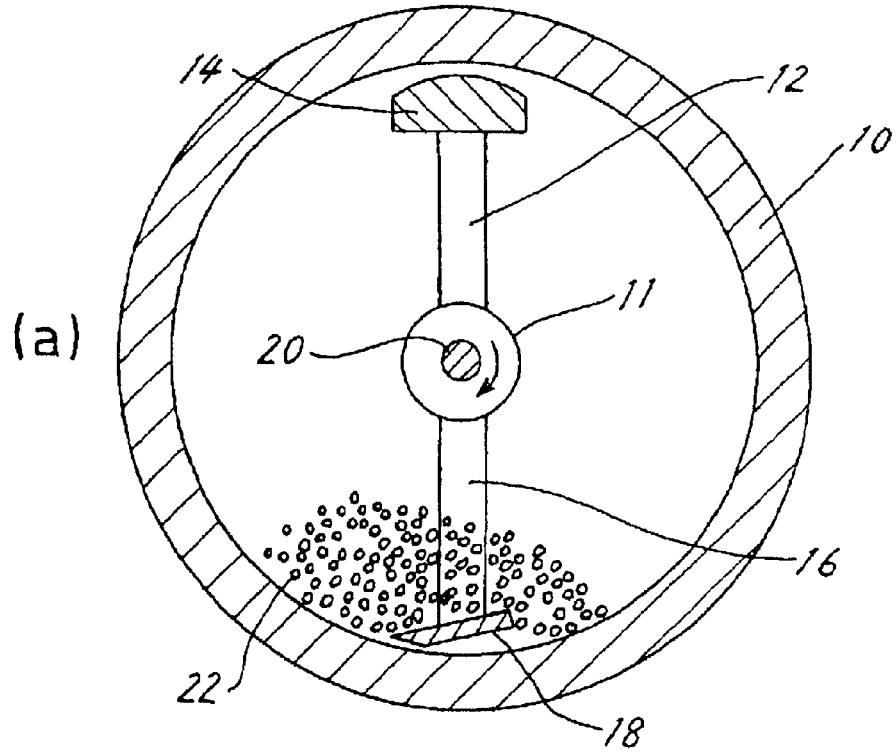
FIG. 5 includes diagrams for illustrating a powder coating apparatus.
Figure 5:
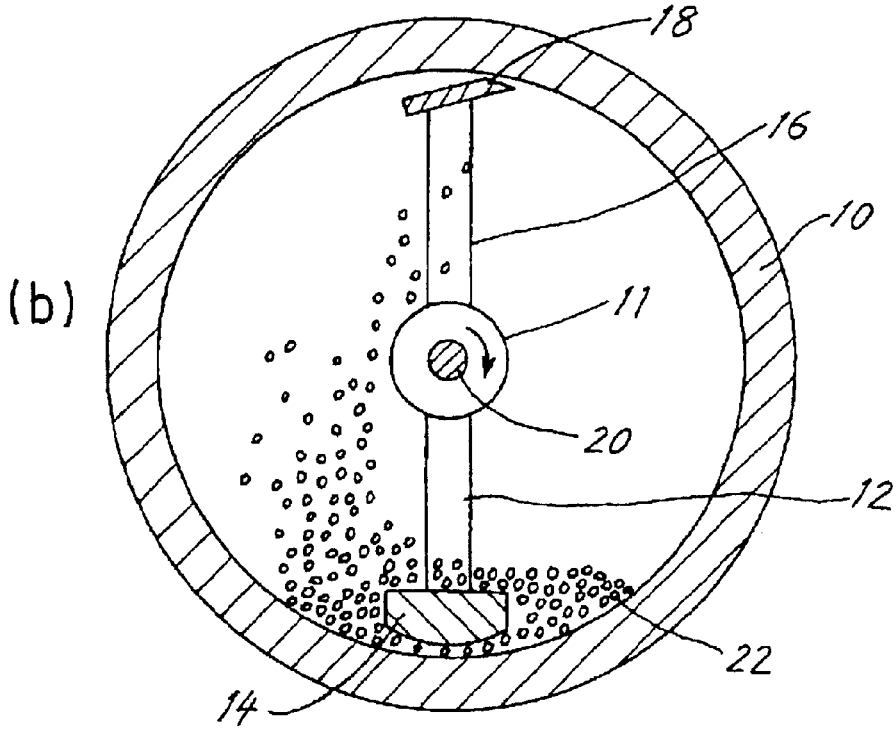

The powder of composite particles can be prepared, for example, by using a powder coating apparatus shown in FIG. 5. FIG. 5 includes views showing the powder coating apparatus to be used for preparing the composite particles, i.e., views in section taken along a direction orthogonal to the axis of a cylindrical container 10 of the apparatus at a position close to one end of the container.

With reference to FIG. 5, the cylindrical container 10, which is hermetically closable, has in its interior a first arm 12 radially projecting from a boss 11 secured to a rotary shaft 20. The first arm 12 is provided at its outer end with a pressing member 14 in the form of a bar extending axially of the container 10 and having an outer surface of arcuate cross section. The pressing member 14 has its outer surface spaced apart from the container inner surface by a predetermined distance so as to apply pressure to and compress a powder 22. A second arm 16 extends from the boss 11 radially of the container 10 in a direction opposite to the first arm 12. The second arm 16 is provided at its outer end with a scraper 18 in the form of a plate elongated axially of the container 10. The scraper is disposed nearly in contact with the container inner surface so as to scrape off the powder 22. The container 10 can be given a vacuum or an inert gas atmosphere.

The rotary shaft 20 is coupled to a rotary drive device (not shown). The first arm 12 and the second arm 16 are rotatable with the shaft 20 at a high speed. FIG. 5, (a) is a view showing the apparatus with the scraper 18 in the lowermost position, and FIG. 5, (b) is a view showing the apparatus with the pressing member 14 in the uppermost position.

Using this powder coating apparatus, the powder of composite particles is prepared in the following manner.

An amorphous magnetically soft alloy powder and a glass powder are placed into the container 10, and stirred by being scraped off by the scraper 18. The powders are then pressed by the pressing member 14 against the inner peripheral surface of the container 10 and thereby subjected to an intense compressive frictional action. The powders are thus acted on repeatedly at a high speed, whereby the particulate alloy and the particulate glass are fused to each other over their surfaces, with the glass particles thermally joined to one another. Consequently, the amorphous magnetically soft alloy particles 3 are coated with a layer 36 of the glass to give composite particles (see FIG. 2).

Preferably, the glass layer is up to about 3 $\mu$m in thickness because if the thickness exceeds 3 $\mu$m, the glass layer is liable to chip and become uneven in thickness to result in impaired insulation.

To prevent oxidation, the composite particles are prepared in an inert gas atmosphere or vacuum. A vacuum is preferably used because no gas molecules are then present which will hamper solid-solid joining, consequently promoting formation of composite particles.

The composite powder obtained is mixed with a binding resin in the form of a powder, liquid or gel in the same manner as in the case of the powder I to prepare a material powder.

Material Powder III

Figure 3:
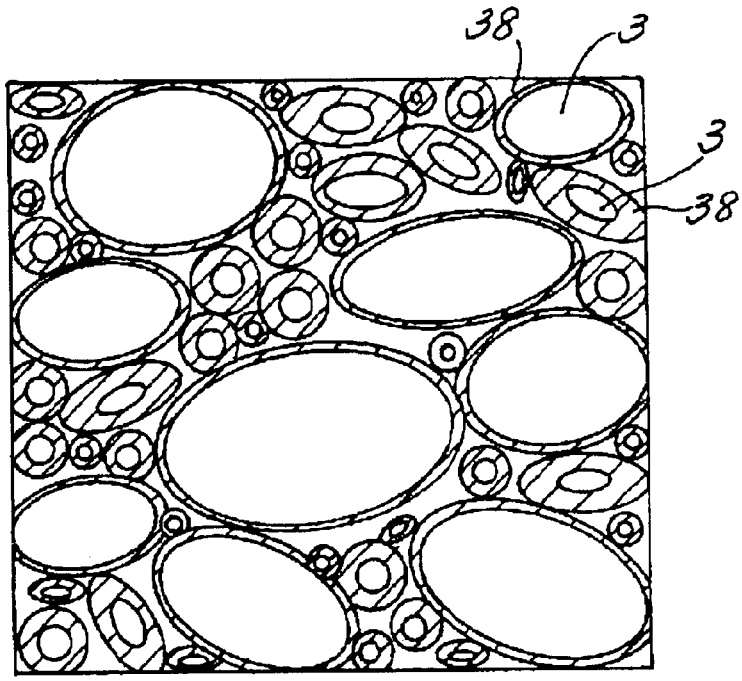
FIG. 3 is a diagram schematically showing a material powder III.

The material powder III comprises composite particles which are prepared by coating an amorphous magnetically soft alloy powder with both glass and binding resin over the surface thereof. FIG. 3 is a diagram schematically showing this material powder.

The amorphous magnetically soft alloy powder can be coated with the glass and binding resin by the powder coating apparatus used for preparing the material powder II. When the apparatus is operated with an amorphous magnetically soft alloy powder, a glass powder and a binding resin powder placed in the container 10, the particulate alloy, particulate glass and particulate resin are fused to one another over their surfaces by a compressive frictional action, whereby the surfaces of the alloy particles 3 are coated with a layer 38 of the glass and the binding resin to afford composite particles.

Preferably, the coating layer over the surfaces of the alloy particles is up to about 3 $\mu$m in thickness because if the thickness exceeds 3 $\mu$m, the coating layer is liable to chip and become uneven in thickness to result in impaired insulation.

Figure 4:
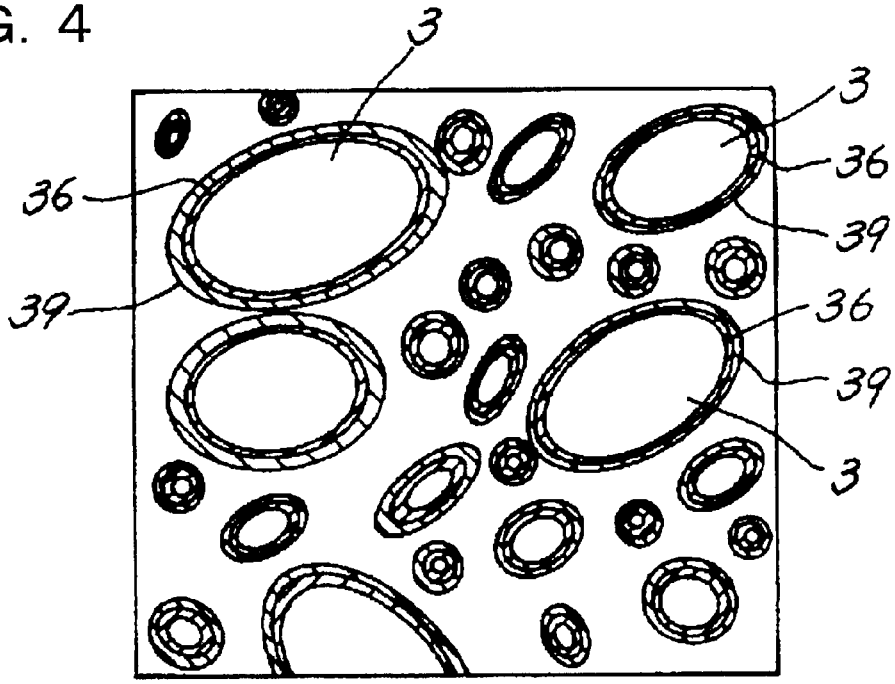
FIG. 4 is a diagram schematically showing a material powder III' or III"

As a modification of the material powder III, the amorphous magnetically soft particles 3 can be coated with a glass layer 36 over the surfaces thereof and further with a binding resin layer 39 as formed over the layer 36 as shown in FIG. 4, by placing the alloy particles and the glass powder into the powder coating apparatus, coating the alloy particles with the glass to form a glass layer over the surfaces of the alloy particles, and thereafter placing the binding resin powder into the apparatus. [The resulting powder will be referred to hereinafter as "powder III' or III".]

In this case, it is desired that the glass layer be up to about 3 $\mu$m in thickness because if the thickness exceeds 3 $\mu$m, the glass layer is liable to chip and become uneven in thickness to result in impaired insulation.

The binding resin evaporates off when the preformed body is heated, so that when the binding resin layer has an excessive thickness, the amorphous magnetically soft body produced has many voids remaining therein and is likely to have an impaired strength. Preferably, therefore, the binding resin layer has a thickness of up to about 1$\mu$m.

Preparation of Preformed Body

The material powder prepared by the foregoing procedure is filled into a preforming die and pressed for forming. The pressure applied affords a preformed body wherein the particles are consolidated with the binding resin. The material powder is thus formed preferably at room temperature but can be suitably heated for forming in accordance with the degree of softening of the resin. (Even in this case, however, the heating temperature during pressing should be lower than the softening point of the glass.)

Preferably, the pressure to be applied for preforming is 500 to 3000 MPa. Such a high pressure is applied for preforming because no pressure is applied to the preformed body in the next firing step and further because the compactness of the amorphous magnetically soft body is accordingly determined by the pressure used for preforming.

A compacted bulked body is obtained by preforming. When released from the preforming die, the preformed body retains its shape unless it is subjected to an excessive force.

The powder III' or III" wherein the alloy particles are coated with the glass layer over the surfaces thereof and further with the binding resin layer over the glass layer has the binding resin layer as the outermost layer of each particle. Accordingly, the powder has the advantages that when pressed, the particles are readily consolidated into a body by the resin layer over the particle surfaces, and that the preformed body obtained is resistant to collapsing.

Formation of Amorphous Magnetically Soft Body

The preformed body obtained is heated without pressing, whereby an amorphous magnetically soft body is produced.

The heating temperature, i.e., the firing temperature, is adjusted to a level higher than the softening point of the glass and lower than the crystallization starting temperature of the amorphous magnetically soft alloy. For example, when prepared from an amorphous magnetically soft Fe alloy, Fe-Si-B, having a crystallization starting temperature of about 500° C. and a borate glass having a softening point of about 320 to about 400° C., the preformed body can be fired at a temperature of about 400 to about 480°C. for 5 to 30 minutes.

When the preformed body is heated to a temperature higher than the softening point of the glass, the glass exhibits flowability. In this state, the glass which is flowable ingresses into and fills up the voids between the alloy particles.

The glass functions as a binder, imparting the desired mechanical strength to the amorphous magnetically soft body obtained, and serves also as an insulator between the alloy particles. This gives the body the advantage of being reduced in power loss due to eddy currents and being less diminished in magnetic permeability in the high-frequency range.

The amorphous magnetically soft body produced by the process of the invention is about 20 to about 100 in magnetic permeability $\mu'$ and is suitable for use as a material for transformers and choke coils.

The amorphous magnetically soft body obtained by the production process of the invention is subjected to a stress relief heat treatment simultaneously with firing.

EXAMPLES

Specific examples will be described below wherein amorphous magnetically soft bodies were produced.

<Preparation of Material Powders>

Material Powder I

A powder of amorphous magnetically soft alloy, $Fe_{78}Si_9B_{13}$ (about 100 mesh in maximum particle size), a glass powder of $PbO \cdot B_2O_3 \cdot SiO_2$ glass (about 10 $\mu$m in mean particle size, 360° C. in softening point) and a powdery epoxy resin (about 100 mesh in maximum particle size) serving as a binding resin were prepared. Amounts of the alloy powder, glass powder and epoxy resin were weighed out so as to be in proportions of 80 vol. %, 5 vol. % and 15 vol. %, respectively, placed into a ball mill and mixed together for 24 hours to obtain a material powder I.

Material Powder II

A powder of amorphous magnetically soft alloy, $Fe_{78}Si_9B_{13}$ (about 100 mesh in maximum particle size), and a glass powder of $PbO \cdot B_2O_3 \cdot SiO_2$ glass (about 10 $\mu$m in mean particle size, 360° C. in softening point) were prepared. Amounts of the alloy powder and the glass powder were weighed out so as to be in proportions of 90 vol. % and 10 vol. %, respectively, and placed into the powder coating apparatus of FIG. 5, which was operated to coat the particles of the alloy serving as base particles with a glass layer over the surfaces, whereby a powder of composite particles was prepared. The composite particles obtained were about 75 $\mu$m in the mean size of the alloy particles and about 2 $\mu$m in the thickness of the glass layer.

The powder of composite particles in an amount of 90 vol. % and 10 vol. % of a powdery epoxy resin (about 100 mesh in maximum particle size) serving as a binding resin were placed into a ball mill and mixed together for 24 hours to prepare a material powder II.

Material Powder III

A powder of amorphous magnetically soft alloy, $Fe_{78}Si_9B_{13}$ (about 100 mesh in maximum particle size), a glass powder of $PbO \cdot B_2O_3 \cdot SiO_2$ glass (about 10 $\mu$m in mean particle size, 360° C. in softening point) and a powdery epoxy resin (about 100 mesh in maximum particle size) serving as a binding resin were prepared. Amounts of the alloy powder, glass powder and epoxy resin were weighed out so as to be in proportions of 80 vol. %, 10 vol. % and 10 vol. %, respectively, and placed into the powder coating apparatus of FIG. 5, which was operated to coat the particles of the alloy serving as base particles with a layer of the glass and the binding resin over the surfaces, whereby a material powder III comprising composite particles was prepared. The composite particles obtained were about 85 $\mu$m in the mean size of the alloy particles and about 3 $\mu$m in the thickness of the layer of glass and binding resin.

Material Powder III'

A powder of amorphous magnetically soft alloy, $Fe_{75}Si_{12.5}B_{12.5}$ (about 100 mesh in maximum particle size), a glass powder of $PbO \cdot B_2O_3 \cdot SiO_2$ glass (about 10 $\mu$m in mean particle size, 360° C. in softening point) and a PVB solution serving as a binding resin were prepared.

First, amounts of the alloy powder and the glass powder were weighed out so as to be in proportions of 95 vol. % and 5 vol. %, respectively, and placed into the powder coating apparatus of FIG. 5, which was operated to coat the particles of the alloy serving as base particles with a glass layer over the surfaces.

To the powder obtained were added 5 wt. % of the PVB resin and 0.5 wt. to 2.0 wt. % of stearic acid serving as a lubricant, and the resulting mixture was kneaded in a mixer to coat the alloy particles further with a binding resin layer over the glass layer, whereby a material powder III' comprising composite particles was prepared. The composite particles obtained were about 85 $\mu$m in the mean size of the alloy particles, about 2 $\mu$m in the thickness of the glass layer and about 0.5 $\mu$m in the thickness of the binding resin layer.

Material Powder III"

A powder of amorphous magnetically soft alloy, $Fe_{75}Si_{12.5}B_{12.5}$ (about 100 mesh in maximum particle size), a glass powder of $PbO \cdot B_2O_3 \cdot SiO_2$ glass (about 10 $\mu$m in mean particle size, 360° C. in softening point) and a PVA solution serving as a binding resin were prepared.

First, amounts of the alloy powder and the glass powder were weighed out so as to be in proportions of 95 vol. % and 5 vol. %, respectively, and placed into the powder coating apparatus of FIG. 5, which was operated to coat the particles of the alloy serving as base particles with a glass layer over the surfaces.

To the powder obtained were added 5 wt. % of the PVA resin and 0.5 wt. % to 2.0 wt. % of stearic acid serving as a lubricant, and the resulting mixture was kneaded in a mixer to coat the alloy particles further with a binding resin layer over the glass layer, whereby a material powder III" comprising composite particles was prepared. The composite particles obtained were about 85 $\mu$m in the mean size of the alloy particles, about 2 $\mu$m in the thickness of the glass layer and about 0.5 $\mu$m in the thickness of the binding resin layer.

<Preparation of Preformed Body>

The material powder was filled into a preforming die (made of SKD11) for cold pressing and pressed at 1500 MPa in an atmosphere of room temperature to prepare a preformed annular body measuring 30 mm in outside diameter, 20 mm in inside diameter and 8 mm in height. The preformed body obtained was taken out of the die and observed to find that the composite particles were consolidated into a body with the binding resin. When taken out of the preforming die, the preformed body remained free of collapsing, retaining the specified shape.

<Formation of Amorphous Magnetically Soft Body>

Figure 6:
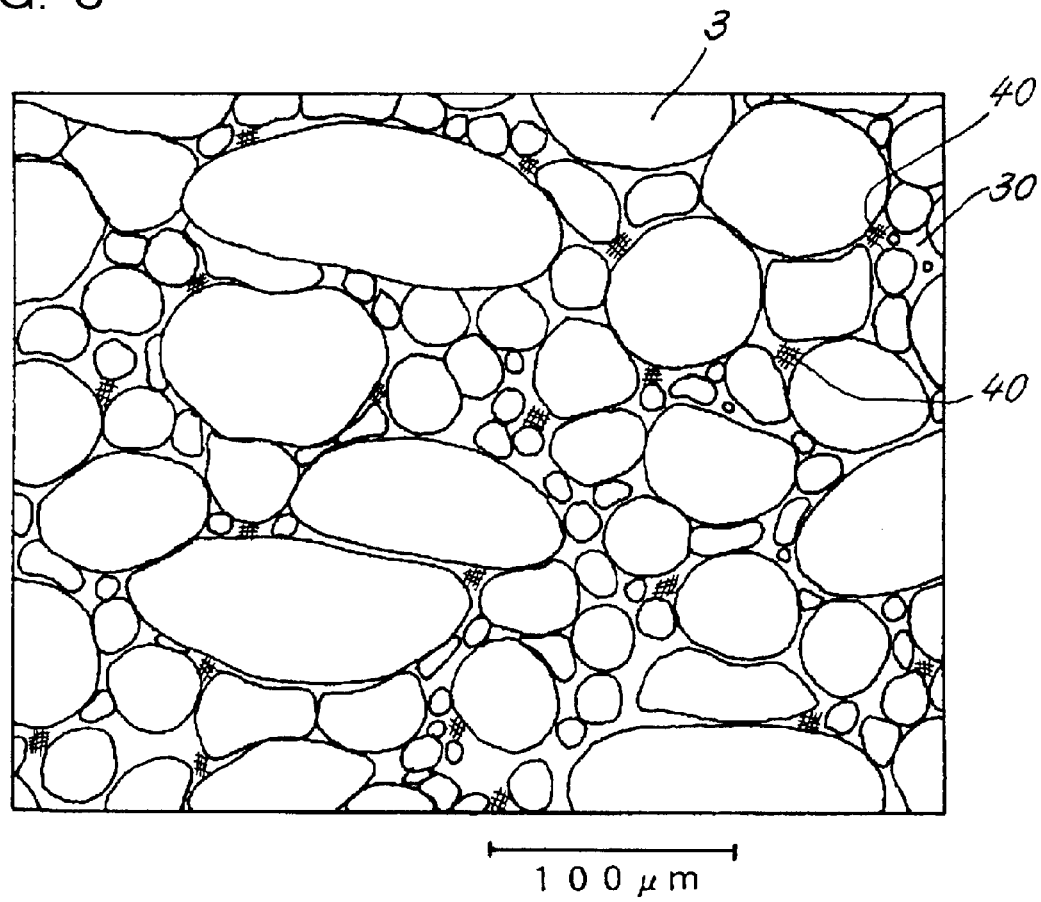
FIG. 6 is a view in section of an amorphous magnetically soft body produced.

The preformed body was held in a vacuum at 480° C. for 15 minutes for firing. Consequently, the binding resin in the preformed body evaporated off, the glass over the surfaces of the composite particles started to soften, and an amorphous magnetically soft body was produced wherein the particles were joined to one another with the glass in place of the binding resin as shown in FIG. 6. It was found that some of the voids 40 formed by the evaporation of the binding resin were progressively filled with the softened glass, and the amorphous magnetically soft body produced was slightly smaller than the preformed body in volume.

Amorphous magnetically soft bodies were produced from the respective material powders I, II, III, III' and III" in the same manner as described above, were found to be 80%, 85%, 83%, 87% and 87%, respectively, in relative density when checked, and were all compacted formed bodies. Incidentally, the term "relative density" refers to the ratio of the actual weight of an amorphous magnetically soft body to the weight of the body which is assumed to be a completely compacted body. The weight of the completely compacted body is a value calculated based on the mixing ratio between the amorphous magnetically soft alloy and the glass powder.

<Finished Bodies>

When checked for magnetic characteristics, the amorphous magnetically soft annular bodies obtained were about 50 to about 100 in magnetic permeability $\mu'$. These bodies were magnetic cores wherein the eddy currents occurring between the particles were suppressed to result in a diminished core loss and which had outstanding high-frequency characteristics.

Figure 7:
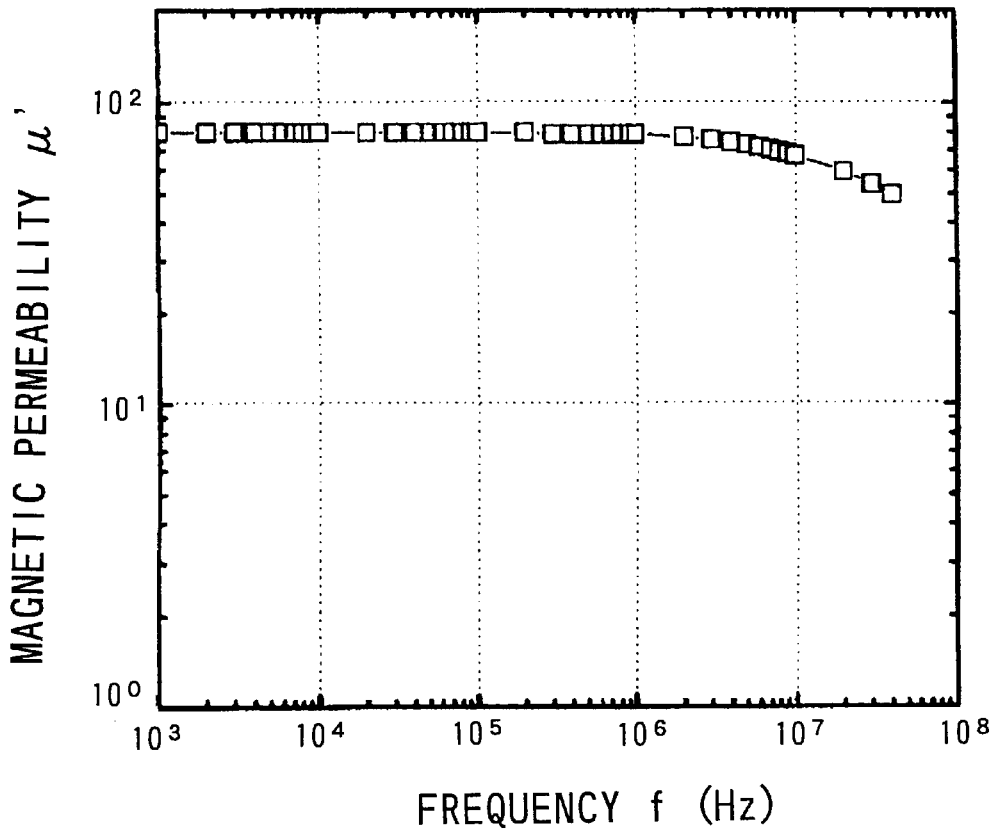
FIG. 7 is a graph showing the magnetic permeability $\mu'$ of an amorphous magnetically soft body produced from the powder III'.

FIG. 7 shows the magnetic permeability $\mu'$ of the amorphous magnetically soft body produced from the powder III'. FIG. 7 reveals that the body produced by the process of the invention exhibits satisfactory high-frequency characteristics without becoming impaired in magnetic permeability $\mu'$ in the high-frequency range.

The process of the present invention is usable also for producing press-formed powder bodies having a finely crystalline phase from an amorphous magnetically soft alloy powder as the starting alloy. The firing temperature in this case is the crystallization starting temperature.

Apparently, the present invention can be modified or altered by one skilled in the art without departing from the spirit of the invention. Such modifications are included within the scope of the invention as set forth in the appended claims.

What is claimed is:

1. A process for producing an amorphous magnetically soft body comprising:

pressing a material powder comprising a powder of an amorphous magnetically soft alloy, a glass having a softening point lower than the crystallization starting temperature of the alloy and a binding resin to prepare a preformed body by the binding property of the resin, and firing the resulting preformed body without pressing at a temperature higher than the softening point of the glass and lower than the crystallization starting temperature of the alloy to join the particles of the alloy with the glass.

2. The process for producing an amorphous magnetically soft body according to claim 1 wherein the glass included in the material powder is in the form of a powder.

3. The process for producing an amorphous magnetically soft body according to claim 1 wherein the glass included in the material powder is applied to the surfaces of the particles of the alloy by coating.

4. The process for producing an amorphous magnetically soft body according to claim 1 wherein the glass and the binding resin included in the material powder are applied to the surfaces of the particles of the alloy by coating.

5. The process for producing an amorphous magnetically soft body according to claim 4 wherein the material powder is prepared by coating the particles of the alloy with the glass over the surfaces thereof to form a glass layer, and coating the surface of the glass layer with the binding resin.

* * * * *